US007344143B2

(12) United States Patent
Chang

(10) Patent No.: US 7,344,143 B2
(45) Date of Patent: Mar. 18, 2008

(54) ROLLER SKATE HAVING A SAFETY DEVICE

(75) Inventor: Chuck Chang, Taichung (TW)

(73) Assignee: Lotuskate Sports Industrial Co., Ltd., Taichung (TW)

( * ) Notice: Subject to any disclaimer, the term of this patent is extended or adjusted under 35 U.S.C. 154(b) by 192 days.

(21) Appl. No.: 11/197,411

(22) Filed: Aug. 5, 2005

(65) Prior Publication Data

US 2005/0263968 A1 Dec. 1, 2005

Related U.S. Application Data

(63) Continuation-in-part of application No. 10/350,065, filed on Jan. 24, 2003, now abandoned.

(51) Int. Cl.
*A63C 17/14* (2006.01)

(52) U.S. Cl. ..... 280/11.204; 280/11.212

(58) Field of Classification Search ..... 280/11.204, 280/11.207, 11.211, 11.205, 11.212
See application file for complete search history.

(56) References Cited

U.S. PATENT DOCUMENTS 906,281 A * 12/1908 Plimpton ..... 280/11.19
3,008,725 A * 11/1961 Stites ..... 280/11.206
3,823,952 A * 7/1974 Kukulowicz ..... 280/11.205
3,900,203 A * 8/1975 Kukulowicz ..... 280/11.205
5,239,941 A * 8/1993 Chibi ..... 74/502.2
5,280,930 A * 1/1994 Smathers et al. ..... 280/11.212
5,351,974 A * 10/1994 Cech ..... 280/11.212
5,464,235 A * 11/1995 Goldman et al. ..... 280/11.212
5,511,805 A * 4/1996 McGrath ..... 280/11.211
5,769,432 A * 6/1998 Tybinkowski et al. . 280/11.204
5,855,381 A * 1/1999 Kirk ..... 280/11.207
5,984,323 A * 11/1999 Daley ..... 280/11.214
6,729,628 B2 * 5/2004 Bellehumeur et al. . 280/11.215

* cited by examiner

*Primary Examiner*—Christopher P. Ellis
*Assistant Examiner*—Bridget Avery
(74) *Attorney, Agent, or Firm*—Shia Banger

(57) ABSTRACT

A roller skate includes a fixing seat, a plurality of wheels, and a safety device mounted on the wheel. The safety device includes a safety member mounted on the fixing seat and urged on the wheel, so as to adjust a rotation speed of the wheel. Thus, the roller skate can be fixed on the ground without rotation by the safety device, so that the learner can stand on the roller skate without movement so as to practice his/her balance. In addition, the safety member is slightly loosened from the wheels, so that the wheels are rotated at a lower speed, thereby facilitating the learner practicing the skating skill.

7 Claims, 4 Drawing Sheets

ROLLER SKATE HAVING A SAFETY DEVICE

BACKGROUND OF THE INVENTION

1. Field of the Invention

This a Continuation-In-Part application of applicant's former patent application with application Ser. No. 10/350,065, filed on Jan. 24, 2003 now abandoned.

2. Description of the Related Art

A conventional roller skate in accordance with the prior art comprises a toe stop mounted on the front side of the base frame so as to provide a braking effect. However, the roller skate cannot be fixed on the ground without movement, so that the learner cannot stand on the roller skate to practice his/her balance, thereby causing inconvenience to the learner. In addition, the toe stop cannot stop the roller skate at a higher speed, thereby causing danger to the user or the learner.

SUMMARY OF THE INVENTION

The present invention is to mitigate and/or obviate the disadvantage of the conventional roller skate.

The primary objective of the present invention is to provide a roller skate having a safety device, wherein the roller skate can be fixed on the ground without rotation by the safety device, so that the learner can stand on the roller skate without movement so as to practice his/her balance.

Another objective of the present invention is to provide a roller skate having a safety device, wherein when the learner can stand on the roller skate steadily and stably, the safety member is slightly loosened from the first and fourth wheels, so that the first and fourth wheels are rotated at a lower speed, thereby facilitating the learner practicing the skating skill.

In accordance with the present invention, there is provided a roller skate, comprising:

a fixing seat;

a plurality of wheels each rotatably mounted on the fixing seat;

a safety device mounted on at least one of the wheels, wherein:

the safety device includes a safety member and a elastic locking member, the safety member mounted on the fixing seat and urged on the at least one wheel, so as to adjust a rotation speed of the at least one wheel, the elastic locking is secured on the safety member and locked in the fixing seat, so as to keep the safety member's position.

Further benefits and advantages of the present invention will become apparent after a careful reading of the detailed description with appropriate reference to the accompanying drawings.

DETAILED DESCRIPTION OF THE INVENTION

Figure 1:
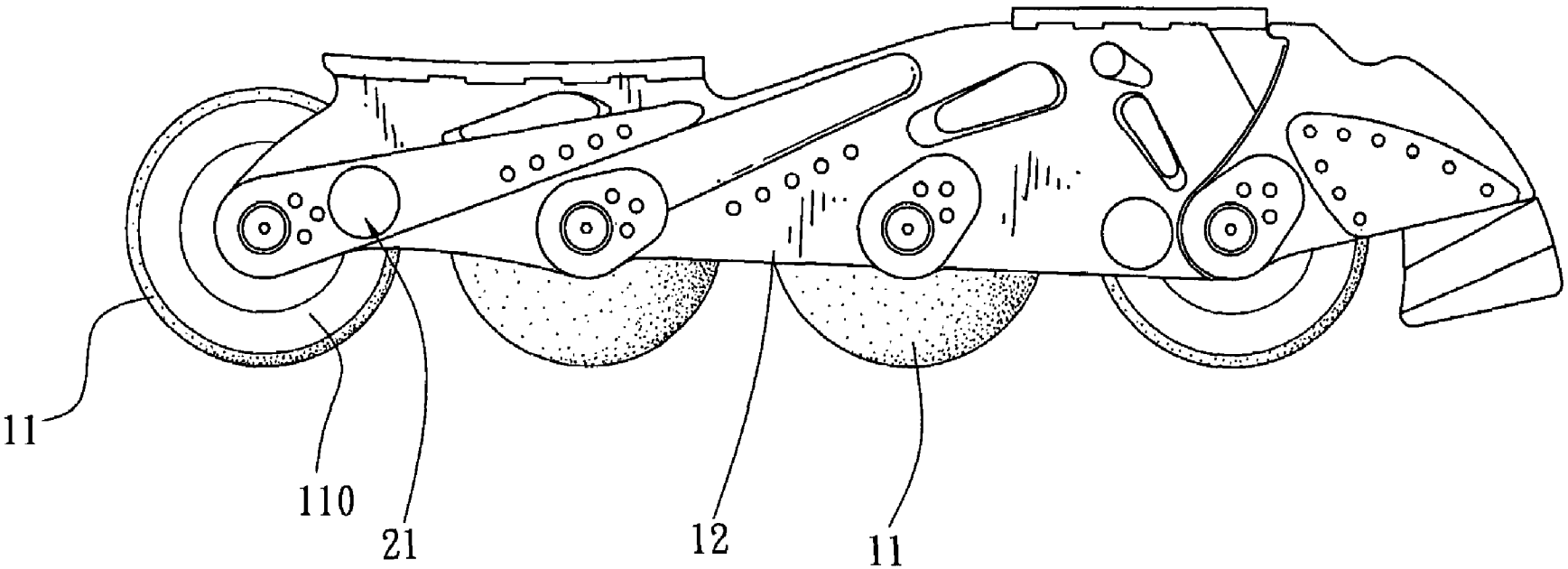
FIG. 1 is a side plan view of a roller skate having a safety device in accordance with the first embodiment of the present invention.

Referring to the drawings and initially to FIGS. 1-4, a roller skate (or in-line roller skate, skateboard, scooter or the like) 10 in accordance with a first embodiment of the present invention comprises a fixing seat 12, and a plurality of wheels 11 each rotatably mounted on the fixing seat 12. The roller skate 10 further comprises a safety device mounted on at least one of the wheels 11.

The safety device includes a safety member 21 mounted on the fixing seat 12 and urged on the wheel 11, so as to adjust a rotation speed of the wheel 11. The fixing seat 12 is formed with a threaded positioning portion 13 (such as a screw bore). The safety member 21 includes a threaded adjusting portion 210 (such as a threaded rod) screwed into the positioning portion 13 of the fixing seat 12, a brake portion 211 formed on a first end of the adjusting portion 210 and rested on a rim of the wheel 11, and a circular adjusting knob 212 formed on a second end of the adjusting portion 210 for rotating the adjusting portion 210. In such a manner, the brake portion 211 of the safety member 21 rubs the rim of the wheel 11, thereby producing a safety braking effect. In addition, the rim of each of the wheels 11 is provided with a rubbing member 110 (see FIG. 3) made of wear-resistant material rested on the brake portion 211 of the safety member 21 to enhance the rubbing effect.

In practice, the safety member 21 can be mounted on the front end and the rear end of the fixing seat 12 to lock the first and fourth wheels 11, thereby fixing the first and fourth wheels 11 on the fixing seat 12 by the safety member 21, so that the roller skate 10 is fixed on the ground without rotation. Thus, the learner can stand on the roller skate 10 without worry of slipping so as to practice his/her balance sensation. When the learner can stand on the roller skate 10 steadily and stably, the safety member 21 is slightly loosened form the first and fourth wheels 11, so that the first and fourth wheels 11 are rotated at a lower speed, thereby facilitating the learner practicing the skating skill.

Figure 2:
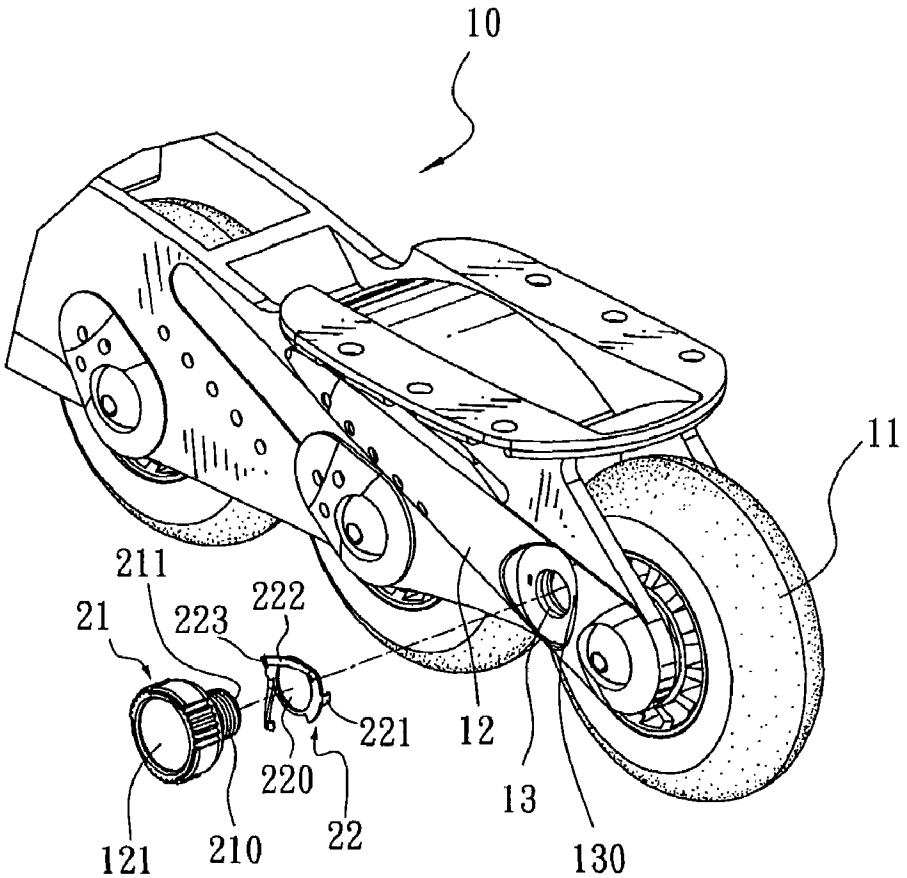
FIG. 2 is a perspective assembly view of the roller skate having a safety device in accordance with the first embodiment of the present invention.
Figure 3:
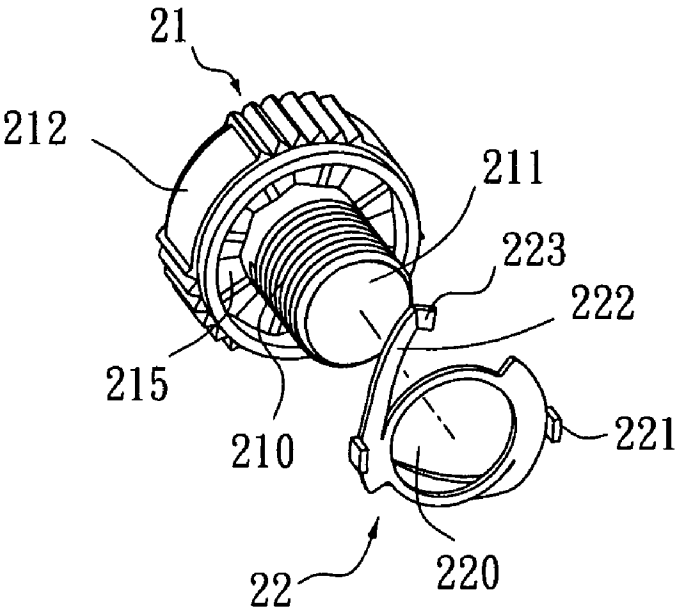
FIG. 3 is an exploded perspective view of a safety device of the roller skate having a safety device in accordance with the first embodiment of the present invention.
Figure 4:
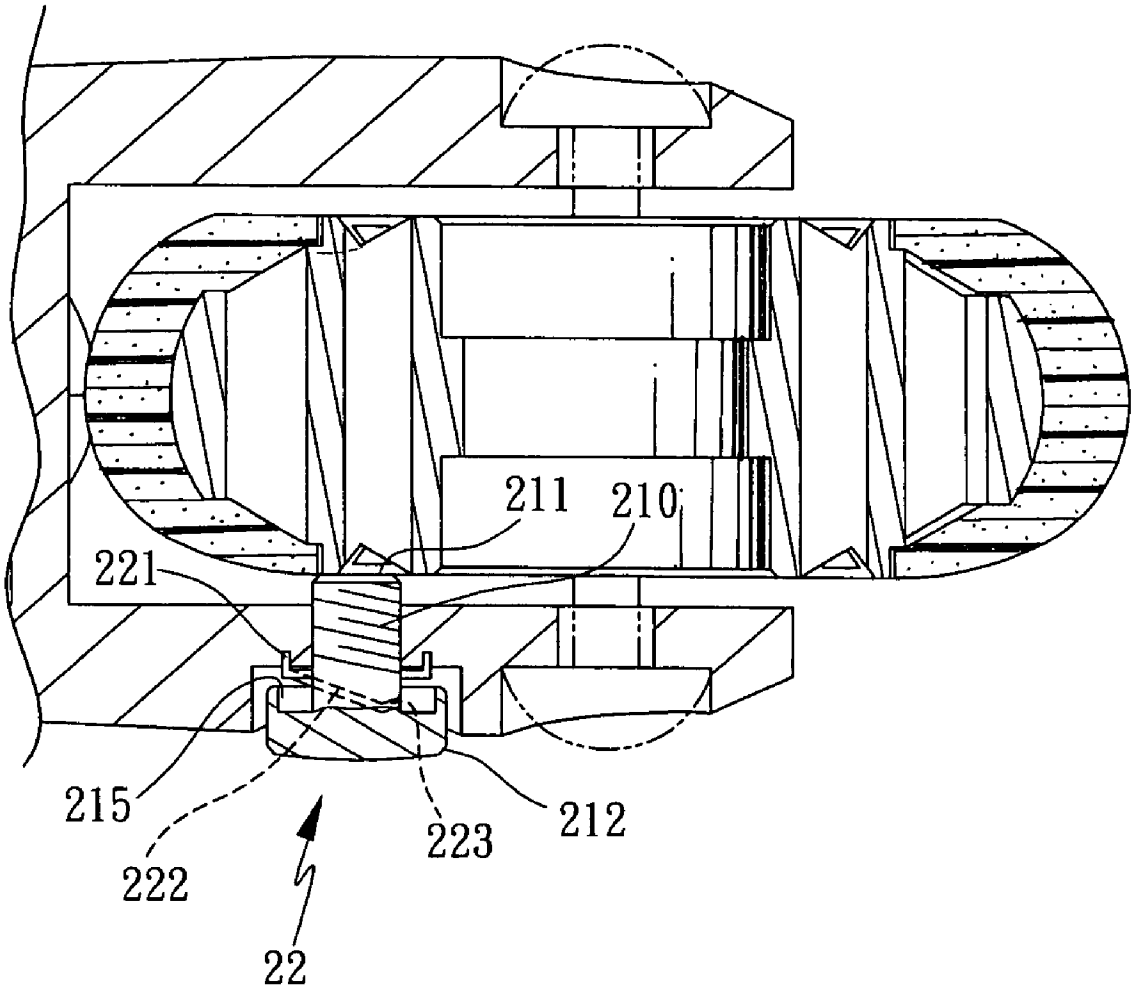
FIG. 4 is a bottom plan view of the roller skate having a safety device in accordance with the first embodiment of the present invention.

Referring to FIGS. 2 and 3, a roller skate 10 in accordance with a second embodiment of the present invention is shown, wherein the fixing seat 12 is formed with a threaded positioning portion 13 (such as a screw bore) formed with two opposite locking holes 130. The safety device includes a safety member 21, and an elastic locking member 22.

The safety member 21 includes a threaded adjusting portion 210 (such as a threaded rod) screwed into the positioning portion 13 of the fixing seat 12, a brake portion 211 formed on a first end of the adjusting portion 210 and rested on a rim of the wheel 11, and a circular adjusting knob 212 formed on a second end of the adjusting portion 210 for rotating the adjusting portion 210. In such a manner, the brake portion 211 of the safety member 21 rubs the rim of the wheel 11, thereby producing a safety braking effect. The adjusting knob 212 of the safety member 21 has an inner side formed with a plurality of teeth 215.

The elastic locking member 22 is mounted on the adjusting portion 210 of the safety member 21 and is formed with a through hole 220 through which the adjusting portion 210 of the safety member 21 extends. The elastic locking member 22 has a periphery formed with two opposite locking blocks 221 each locked in a respective one of the two opposite locking holes 130 of the fixing seat 12, and formed with two opposite oblique elastic plates 222 each having a distal end formed with a locking portion 223 engaged with the teeth 215 of the adjusting knob 212 of the safety member 21.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A roller skate, comprising:

a fixing seat formed with a positioning portion;

a plurality of wheels each rotatably mounted on the fixing seat;

a safety device mounted on at least one of the wheels, wherein the safety device includes a safety member and an elastic locking member, the safety member being mounted on the fixing seat and urged on the at least one wheel to adjust a rotation speed of the at least one wheel, the elastic locking member locked and secured between the safety member and the fixing seat to position the safety member, the safety member including (a) an adjusting portion extended through the positioning portion of the fixing seat, (b) a brake portion formed on a first end of the adjusting portion and rested on a rim of the at least one wheel, and (c) a circular adjusting knob formed on a second end of the adjusting portion for rotating the adjusting portion.

2. The roller skate in accordance with claim 1, wherein the positioning portion of the fixing seat is a screw bore.

3. The roller skate in accordance with claim 1, wherein the adjusting portion of the safety member is a threaded rod.

4. The roller skate in accordance with claim 1, wherein the rim of each of the wheels is provided with a rubbing member made of wear-resistant material so as to be in contact with the brake portion of the safety member.

5. The roller skate in accordance with claim 1, wherein the fixing seat is formed with a threaded positioning portion formed with two opposite licking holes, the safety member includes a threaded adjusting portion screwed into the positioning portion of the fixing seat, a brake portion formed on a first end of the adjusting portion and rested on a rim of the at least one wheel, and a circular adjusting knob formed on a second end of the adjusting portion for rotating the adjusting portion, the locking member is secured on the safety member and has a periphery formed with two opposite locking blocks each locked in a respective one of the two opposite locking holes of the fixing seat.

6. The roller skate in accordance with claim 5, wherein the adjusting knob of the safety member has an inner side formed with a plurality of teeth, and the periphery of the locking member is formed with an oblique elastic plate which has a distal end formed with a locking portion engaged with the teeth of the adjusting knob of the safety member.

7. The roller skate in accordance with claim 5, wherein the elastic locking member is formed with a through hole through which the adjusting portion of the safety member extends.

* * * * *